United States Patent [19]

Nassau et al.

[11] Patent Number: 4,590,723

[45] Date of Patent: May 27, 1986

[54] LAMBREQUIN ASSEMBLY

[76] Inventors: Lewis Nassau, 217 Forest Dr., Hillsdale, N.J. 07642; Mordache Sabbah, 78-55 Boulevard East, North Bergen, N.J. 07047

[21] Appl. No.: 727,005

[22] Filed: Apr. 25, 1985

Related U.S. Application Data

[63] Continuation-in-part of Ser. No. 589,660, Mar. 14, 1984.

[51] Int. Cl.[4] ..... E06B 1/04

[52] U.S. Cl. ..... 52/211; 52/716

[58] Field of Search ..... 52/204, 211, 212, 283, 52/311, 312, 475, 656, 716; 49/504, DIG. 2

[56] References Cited

U.S. PATENT DOCUMENTS

| | | | |
|---|---|---|---|
| 2,782,541 | 2/1957 | Spertus | 52/716 X |
| 2,804,952 | 9/1957 | Nothdurft | 52/475 |
| 2,918,153 | 12/1959 | Hammitt et al. | 52/204 |
| 3,728,833 | 4/1973 | Grossman | 52/311 |
| 3,800,488 | 4/1974 | Swanson | 52/212 |
| 4,193,238 | 3/1980 | Chalmers et al. | 52/211 |
| 4,243,711 | 1/1981 | Wenrick | 52/716 X |

FOREIGN PATENT DOCUMENTS

| | | | |
|---|---|---|---|
| 2327466 | 12/1974 | Fed. Rep. of Germany | 52/204 |

*Primary Examiner*—William F. Pate, III
*Assistant Examiner*—Creighton Smith
*Attorney, Agent, or Firm*—Edward M. Blocker

[57] ABSTRACT

A lambrequin assembly includes a plurality of channels for receiving at least one strip of decorative material in at least one of a plurality of sections of the assembly. The sections are joined together by L-shaped connectors which are frictionally held within grooves formed on the rear surface of each section. Corner and bottom brackets slidably receive and engage the corners and ends of the sections respectively, providing a finished and attractive assembly.

19 Claims, 17 Drawing Figures

200
22
20
40
46
47
48
49
50
51
21
30
200
215b
216b
51
50
49
48
46
47
46
47
48
49
50
51
23
27
26
21a
W1
30
25
30a
30
24
9B
300
9B
300

FIG. 2
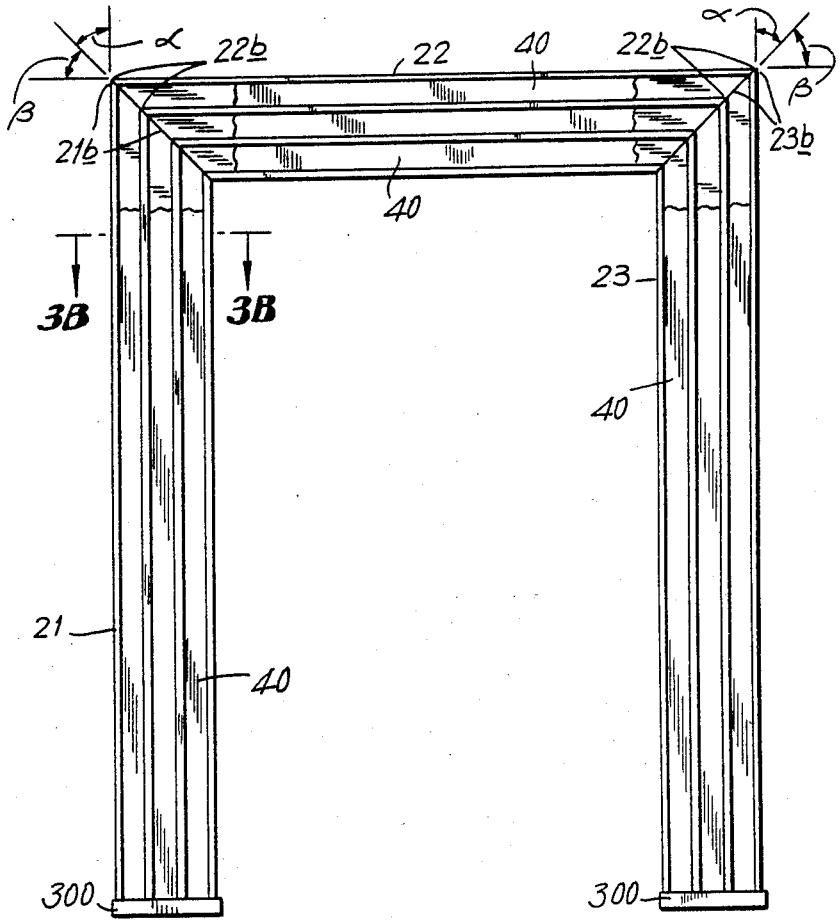
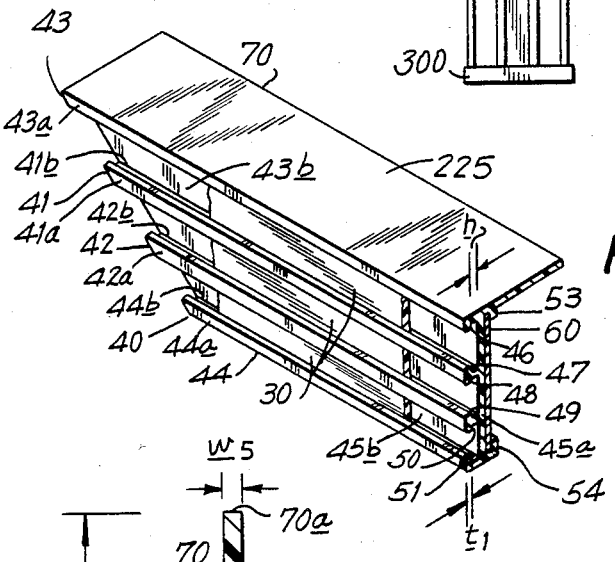
FIG. 3A
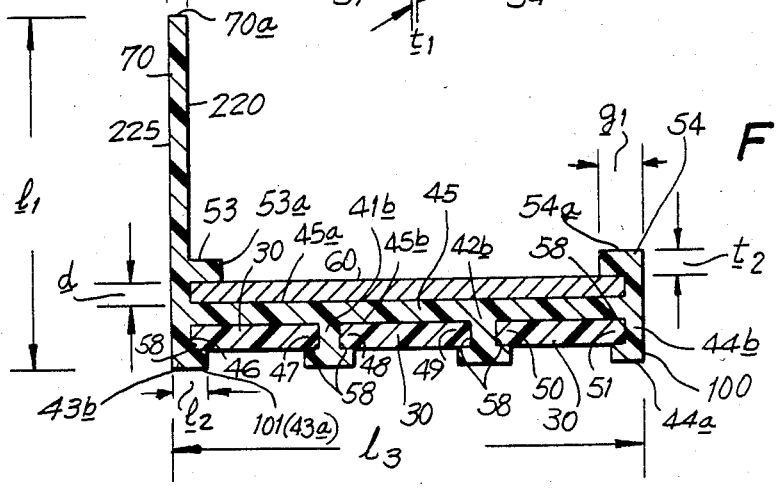
FIG. 3B

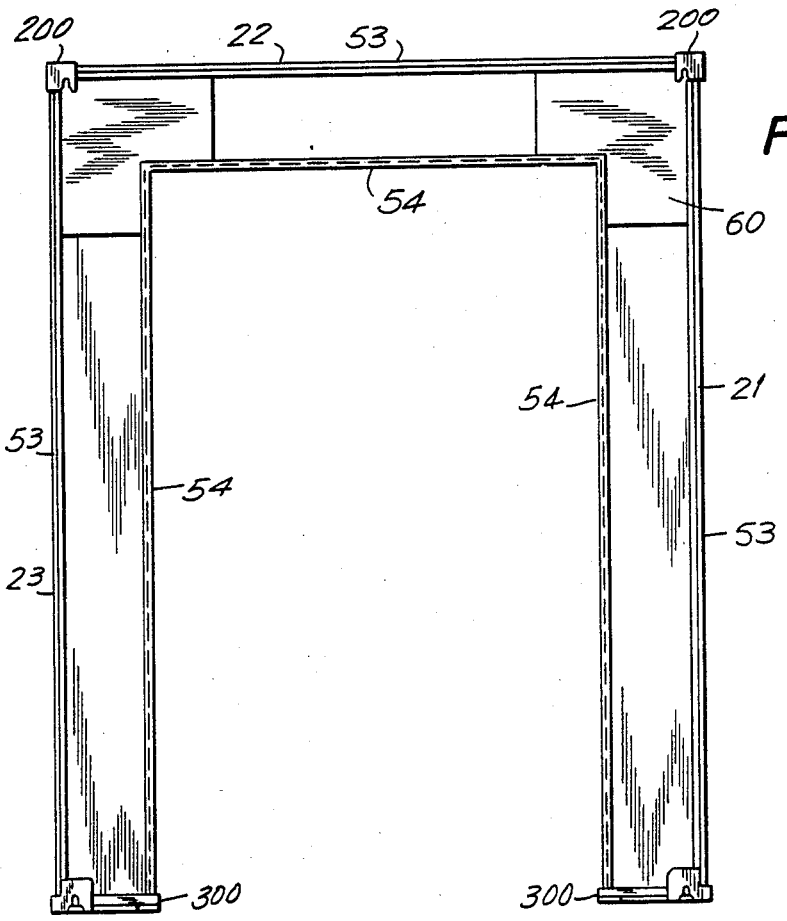
FIG.4
FIG.5
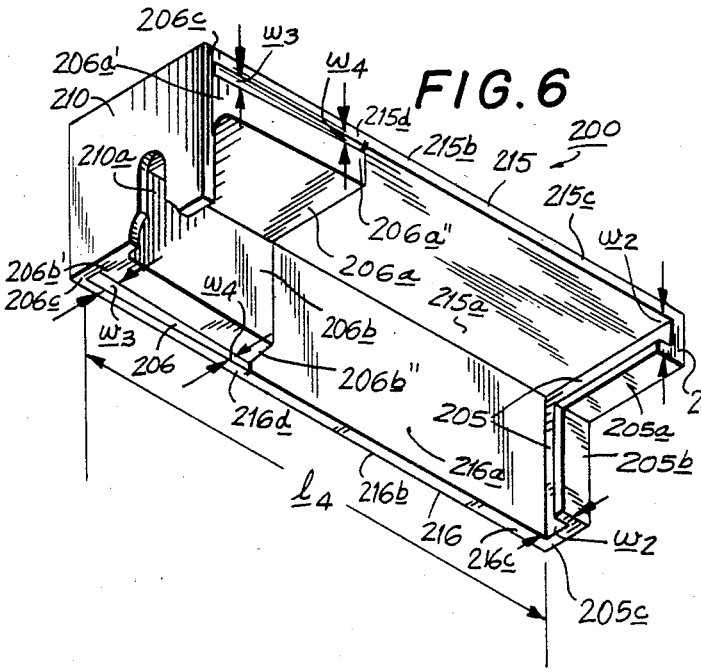
FIG.6
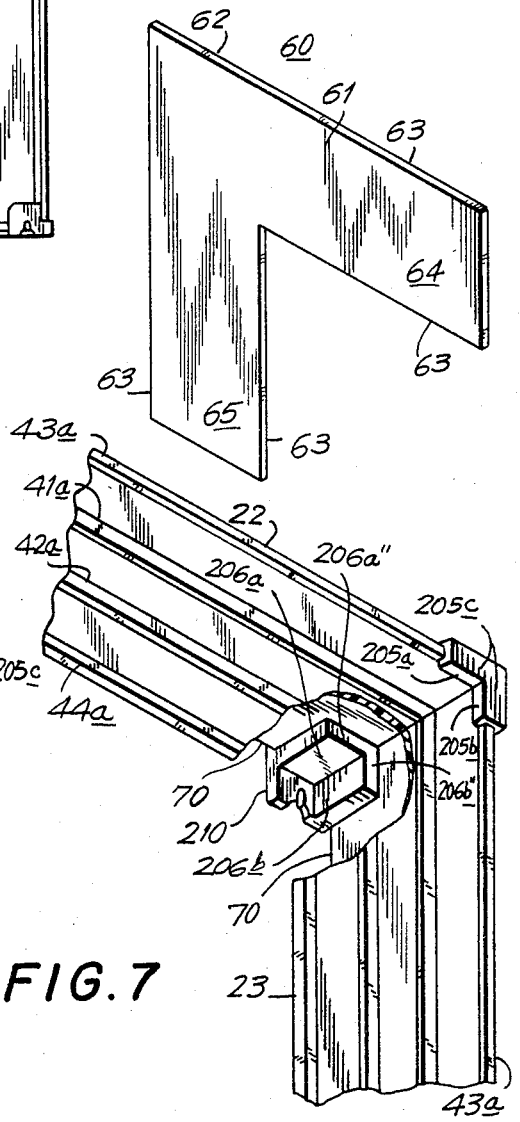
FIG.7

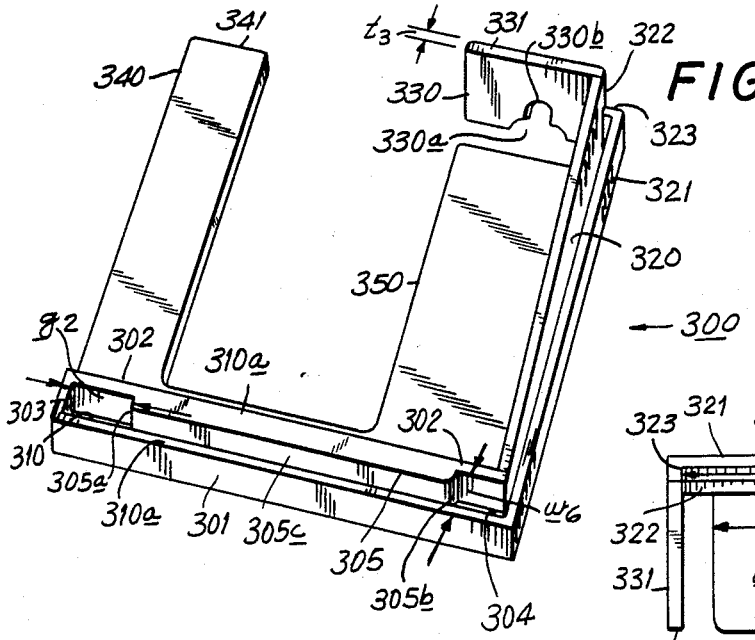
FIG. 8A
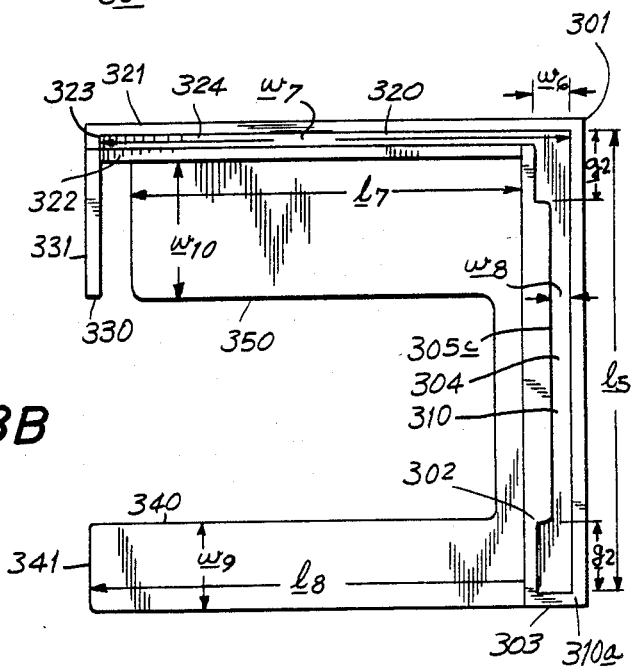
FIG. 8B
FIG. 9A
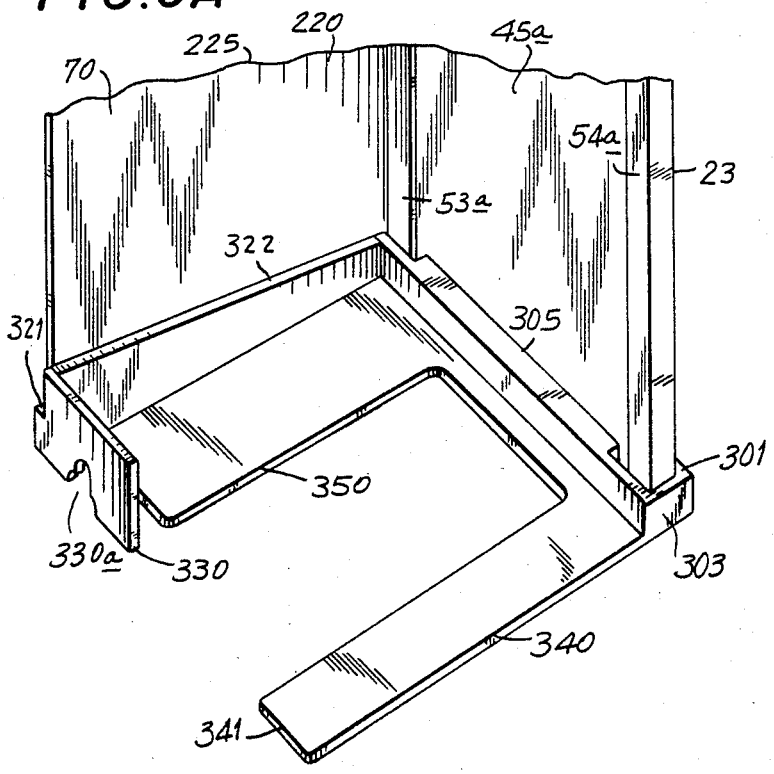
FIG. 9B
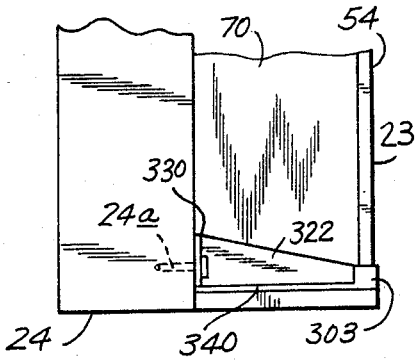

LAMBREQUIN ASSEMBLY

REFERENCE TO RELATED APPLICATION

This application is a continuation-in-part of copending patent application Ser. No. 589,660, filed Mar. 14, 1984.

BACKGROUND OF THE INVENTION

1. Field of the Invention

The present invention relates to lambrequin assemblies for decorating frames of windows, doors, or other similar passageways and more particularly is directed toward lambrequin assemblies for receiving strips of decorative material.

2. Description of the Prior Art

Lambrequin assemblies are used for providing a finished and decorative appearance to top and side borders of passageways which may be covered by a translucent body, such as a window, sliding glass door and the like. Generally, such assemblies are custom-made, that is, hand-crafted in wood which can be optionally treated in a fabric covering. Consequently, the assemblies are not readily available for general sale to the public. Furthermore, because lambrequin assemblies are handcrafted they require a great deal of time to produce and are costly to manufacture.

The foregoing drawbacks are avoided by our copending patent application Ser. No. 589,660 which provides a sectionalized lambrequin assembly having at least two channels for securing and displaying at least one strip of decorative material to at least one of the plurality of sections. The sections are joined together by L-shaped connectors which slide into and engage groove-shaped members located on the rear side of each of the sections.

For securing our lambrequin assembly to the top and side borders of the passageway, our copending application employed a plurality of brackets which were attached to each section using, for example, adhesive. Use of adhesive or other similar means for attaching the brackets to the assembly can be time consuming and inconvenient. Additionally, we have found that the assembly has a tendency to warp inwardly toward the passageway which may result in the assembly becoming somewhat unstable. Furthermore, if any of the sections need to be shortened by cutting out a portion thereof or lengthened by adding an additional section in order for the assembly to conform to the perimeter of the passageway, the edges of the cut sections or the junction(s) formed between the additional and original sections may appear unfinished. Still further, the corners of the assembly, that is, the junctioned where the vertical and horizontal sections meet may, at times, appear unfinished due to potential warpage of the sections relative to each other and/or the edges of adjoining sections not having smooth, clean finishes.

OBJECTS AND SUMMARY OF THE INVENTION

Accordingly, it is an object of the present invention to provide a lambrequin assembly which further improves the assembly disclosed and claimed in our copending application.

More specifically, it is an object of the present invention to provide a new and improved lambrequin assembly which is easily secured to the perimeter of a passageway.

It is another object of the present invention to provide a lambrequin assembly which prevents warping inwardly toward the passageway.

It is still another object of the present invention to ensure that the edges and corners of the lambrequin assembly appear finished.

In accordance with an aspect of the present invention, in a lambrequin assembly having a plurality of sections in which one side of each section includes a strip receiving member for partially concealing the perimeter of a passageway to which the assembly is attached, said strip receiving member having at least inner channel means and outer channel means for receiving and displaying at least one strip of decorative material and in which each section further includes panel means for partially concealing the perimeter of a passageway to which the assembly is attached, corner bracket means for joining two of said plurality of sections together and having front and rear ends comprise front end channel means located at the front end of the corner bracket means and operable for overlapping and slidably receiving each of the outer channel means of the two adjoining sections so as to secure the front end of the corner bracket means in the two adjoining sections at and near the junction formed thereby; and rear end channel means located at the rear end of the bracket means and operable for slidably receiving and engaging each of the panel means of the two adjoining sections so as to secure the rear end of the corner bracket means to the two adjoining sections at and near the junction formed by the two sections.

In a feature of the present invention, the corner bracket means further comprise first back plate means having aperture means for permitting an attaching element to pass therethrough and into the perimeter of the passageway so as to secure the corner bracket means and thereby the two adjoining sections of the lambrequin assembly to the perimeter of the passageway.

In yet another feature of the present invention, the front end channel means and rear end channel means of the corner bracket means each form a path of 90 degrees.

In still another feature of the present invention, the rear end channel means of the corner bracket means comprise two pairs of walls one pair of which are resilient and extend inwarly toward the other pair of walls such that said one pair of walls comes into contact with and presses against each of the slidably received panel means.

In yet another aspect of the present invention, the lambrequin assembly further comprises bottom bracket means which include first trench means operable for seating and supporting the strip receiving member of one of the plurality of sections therein; and second trench means operable for seating and supporting the panel means of said one of said plurality of sections therein.

Features of this latter aspect of the present invention include first ledge means connected to the first trench means and operable for stabilizing said one of the plurality of sections relative to the perimeter of the passageway; second ledge means for preventing warping of the first trench means relative to the second trench means; and second back plate means similar to the first back plate means for securing the bottom bracket means and thereby the lambrequin assembly to the perimeter of the passageway.

In yet another aspect of the present invention, mask means are provided for covering a junction between two of the plurality of sections which are next adjacent each other.

The above and other objects, features and advantages of the invention will become apparent from the following detailed description which is to be read in conjunction with the accompanying drawings.

BRIEF DESCRIPTION OF THE DRAWINGS

FIG. 2 is a front elevational view of the lambrequin assembly without the corner brackets shown in FIG. 1;

FIG. 3A is a front perspective view, partially broken away, of a section of the lambrequin assembly and FIG. 3B is a sectional view taken along the lines 3B—3B of FIG. 2;

FIG. 4 is a rear elevational view of the lambrequin assembly of FIG. 1;

FIG. 5 is a front perspective view of a connector shown in FIG. 4;

FIG. 6 is a side perspective view of the right corner bracket shown in FIG. 1;

FIG. 7 is fragmented front perspective view, partially broken away, of the right corner of the lambrequin assembly shown in FIG. 1;

FIG. 8A is a top perspective view of the right bottom bracket shown in FIG. 1 and FIG. 8B is top plan view of the right bottom bracket;

FIG. 9A is a fragmented rear perspective view about the right bottom bracket of the lambrequin assembly shown in FIG. 1 and FIG. 9B is a fragmented side elevational view of FIG. 1 taken along the lines 9B—9B;

DETAILED DESCRIPTION OF CERTAIN PREFERRED EMBODIMENTS

Figure 1:
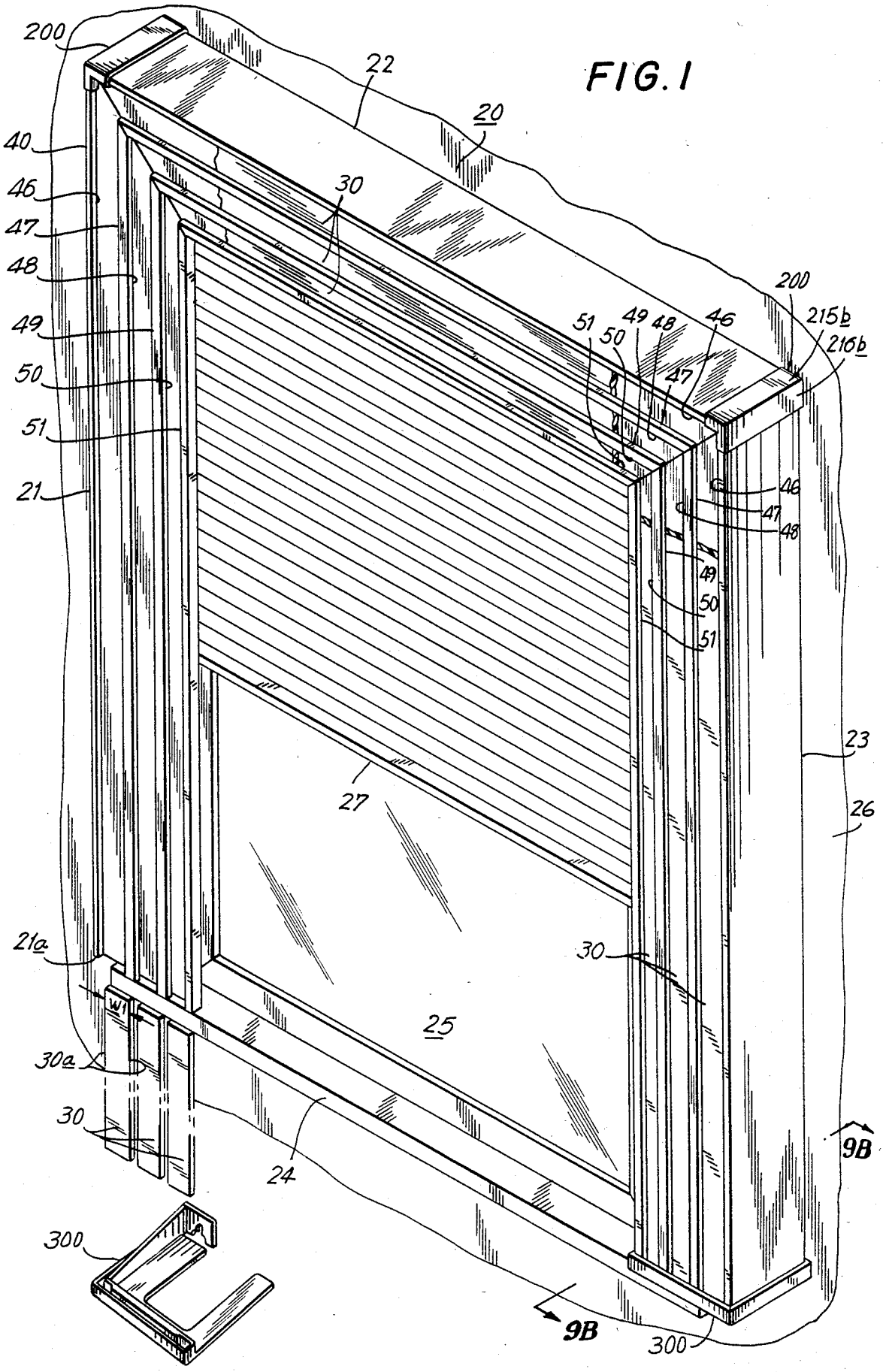
FIG. 1 is a perspective view of a lambrequin assembly about a translucent body which is partially covered by a blind or shade and with decorative strips of material disposed for insertion into and already received by channels of the lambrequin assembly in accordance with an embodiment of the present invention.

Referring now to FIG. 1, a lambrequin assembly 20 having three sections 21, 22 and 23 is affixed to and covers a frame, molding or the like 24. Frame 24 encloses a passageway which is covered by a translucent body 25, such as a window, sliding glass door or the like, mounted on a wall 26. A blind or shade 27 is shown covering a portion of translucent body 25. The types of translucent body coverings, however, are not limited to blinds or shades and can include, for example, drapes or other coverings that fit within the inner perimeter of frame 24. Decorative strips 30, which have sides 30*a*, are slidably inserted into channels 46–47, 48–49, and 50–51 of each section. Strips 30 can be of any decorative style and can be, for example, of a plastic material or of the same material as used for blinds/shades 27 (e.g., flexible or tempered aluminum or fiberglass). For illustrative purposes only, strips 30, inserted into sections 22 and 23 are shown partially broken away so as to expose the slanted angle at the ends of the sections (to be discussed in detail below). Bottom brackets 300, which slide over ends 21*a* and 23*a* of sections 21 and 23, respectively, and corner brackets 200 which slide over adjoining ends of sections 21 and 23 and of sections 22 and 23, are used to secure assembly 20 to frame 24.

As shown more particularly to FIG. 3A, each section is defined by a strip receiving member 40 having a planar body 45 and a panel member 70. Planar body 45 has a planar rear side 45*a* and a planar front side 45*b*. Strip receiving member 40 is also comprised of two T-shaped cross sectional portions 41 and 42 which include tops 41*a* and 42*a* and stems 41*b* and 42*b*, respectively. T-shaped cross sectional portions 41 and 42 are located between two inverted L-shaped cross sectional portions 43 and 44. Portions 41, 42, 43 and 44 are integral with front side 45*b*. Inverted L-shaped cross sectional portions 43 and 44 are located at the sides of strip receiving member 40 with a bottom leg 43*a* of L-shaped cross sectional portion 43 extending towards a bottom leg 44*a* of L-shaped cross sectional portion 44. Portions 43 and 44 also comprise stems 43*b* and 44*b*, respectively. Stems 41*b*, 42*b*, 43*b* and 44*b* are all parallel to each other. Tops 41*a* and 42*a* and legs 43*a* and 44*a* have substantially planar surfaces located at the proximal ends of and which are perpendicular to stem 41*b*, 42*b*, 43*b* and 44*b*, respectively. Tops 41*a* and 42*a* and bottom legs 43*a* and 44*a* are of the same thickness $t_1$, at the same height h above and extend parallel to front side 45*b*. Consequently, a plurality of channels 46, 47, 48, 49, 50 and 51 extending in the same direction and rising above front side 45*b* are formed.

In particular, and as shown in FIG. 3B, portions of which have been exaggerated for illustrative purposes only, each strip of material 30 is slidably received by one of a pair of channels 46–47, 48–49, and 50–51. Stems 41*b*, 42*b*, 43*b* and 44*b* can be viewed as forming walls 58 for controlling, in part, the slidable direction of each strip 30. Accordingly, tops 41*a* and 42*a* and legs 43*a* and 44*a* of FIG. 3A can be viewed as planar surfaces located at the distal ends of and substantially perpendicular to walls 58. Each of strips 30 is dimensioned so as to contact a pair of walls 58 as the strip is slid into the associated pair of channels. In this regard, strips 30 should be sufficiently resilient to ensure contact is made between sides 30*a* of strips 30 and the associated pair of walls 58 as the strips are slid between the latter. Through such contact with a pair of associated walls 58, each strip 30 is frictionally held in place and thus secured to member 40. Once all strips 30 have been inserted into associated pairs of channels, tops 41*a* and 42*a* and legs 43*a* and 44*a* will protrude above and between the inserted strips so as to project an extremely attractive rib-like effect against a background of decorative material.

Strips 30, if sufficiently resilient, also can be inserted into the channels by bending, that is, pinching sides 30*a* of each strip 30 towards each other so as to compress the width $w_1$ of each strip 30 as shown in FIG. 1. Consequently, each strip can be disposed in a compressed shape between an associated pair of channels with sides 30*a* contacting or nearly contacting front side 45*b*.

Upon releasing sides 30*a*, each strip 30 will spring back to its original shape so as to contact walls 58 and thereby be held in place within strip receiving member 40.

Two additional L-shaped cross sectional portions 53 and 54 positioned opposite inverted L-shaped cross sectional portions 43 and 44, respectively, are located on rear side 45*a* of planar body 45. Bottom legs 53*a* and 54*a* of respective portions 53 and 54 are of equal thickness $t_2$, have equal lengths $g_1$, face each other and are at the same depth d below and parallel to rear side 45*a*. Consequently, L-shaped portions 53 and 54 form and hereinafter will be referred to as groove-shaped members which extend in a direction which is parallel to channels 46–51 for receiving an L-shaped connector 60. In each of the sections, panel member 70 comprises a distal end 70*a*, an interior side 220 and an exterior side 225 both sides of which extend in a direction which is substantially perpendicular to planar body 45 and therefore perpendicular to both the direction in which members 53 and 54 extend and the direction in which each of the strips 30 is slidably received by strip receiving member 40.

As shown in FIGS. 3A and 3B, the perpendicular distance between adjacent stems (43*b*–41*b*, 41*b*–42*b*, and 42*b*–44*b*) relative to the direction in which the strips 30 are slidably received by member 40 are equal. These perpendicular distances, however, need not be equal. Additionally, strip receiving member 40 can be modified to accommodate only one strip (in which case two of the four cross sectional portions 41, 42, 43 and 44 would not be included on strip receiving member 40) or any other reasonable number of strips (in which case a suitable number of cross sectional portions 41 and/or 42 are included).

Referring now to FIG. 2, corner brackets 200 have been removed from and strips 30 have been partially broken away at the corners of lambrequin assembly 20 to illustrate the slanted, non-right angles at which two strip receiving members 40 are joined together. More particularly, one end of each strip receiving member 40 of sections 21 and 23 and both ends of strip receiving member 40 of section 22, designated as 21*b*, 23*b* and 22*b*, respectively, are cut at non-right angles. For example, ends 21*b* and 23*b* are cut at angle $\alpha$ and ends 22*b* are cut at angle $\beta$ relative to the direction in which the channels of the associated section extend. Typically, angles $\alpha$ and $\beta$ are equal to 45°.

As shown in FIG. 4, which illustrates a rear view of assembly 20, each of the sections is joined and locked to one of the other sections through an L-shaped connector 60. Connector 60, as illustrated in FIG. 5, has substantially planar front and rear surfaces 61 and 62, respectively, and substantially planar side surfaces 63 which are perpendicular to front surface 61 and rear surface 62. For interlocking section 21 to section 22, a first arm 64 of connector 60 is slid into groove-shaped members 53 and 54 of either section 21 or 22 and then a second arm 65 of connector 60 is slid into groove shaped members 53 and 54 of the other section. Sections 22 and 23 are similarly joined together. Typically, arms 64 and 65 are of equal length. Furthermore, and as can be readily appreciated, the minimum lengths of portions 53 and 54 along each member 40 should be sufficient for fully receiving an arm of connector 60. Connectors 60 and members 53 and 54 of each section are dimensioned such that sides 63 and/or surfaces 61 and 62 of each connector 60 come into contact with and engage groove-shaped members 53 and 54 of each section as connector 60 is slid into the latter. More particularly, the contact established between connector 60 and members 53 and 54 of each section frictionally hold the former to the latter and therefore join the sections together.

Referring now to FIG. 6, corner bracket 200, which has an L-shaped cross section, is comprised of a front end channel 205, a rear end channel 206, a back plate 210 and two side members 215 and 216. Side members 215 and 216, which are integrally connected together at right angles to each other, comprise inner planar surfaces 215*a* and 216*a*, outer planar surfaces 215*b* and 216*b*, and end portions 215*c*, 215*d* and 216*c*, 216*d*, respectively. The front end channel 205 comprises walls 205*a* and 205*b*, base 205*c* and the end portions 215*c* and 216*c* which serve as walls for front end channel 205. Wall 205*a* and end portion 215*c* are parallel to each other. Similarly, walls 205*b* and end portion 216*c* are parallel to each other. Base 205*c* is perpendicular to walls 205*a* and 205*b* and end portions 215*c* and 216*c*. Wall 205*a* and end portion 215*c* are perpendicular to wall 205*b* and end portion 216*c* such that front end channel 205 forms a 90 degree path. The width $w_2$ of front end channel 205, that is, the distance between wall 205*a* and end portion 215*c* or between wall 205*b* and end portion 216*c* is slightly greater than the length $l_2$ of leg 43*a*, shown in FIG. 3B for reasons to be discussed below. Back plate 210 is a rectangular block integrally connected to sides 215 and 216 at end portions 215*d* and 216*d*, respectively. Back plate 210 includes a cut out portion, hereinafter referred to as keyhole 210*a*, located at the distal end thereof. Keyhole 210*a* is not limited to the shape of a keyhole and, in fact, can comprise any type of aperture within back plate 210 which can accommodate the stem of a screw, nail or other attaching element passing therethrough. Rear end channel 206 comprises walls 206*a* and 206*b*, a base served by portions of back plate 210 and the end portions 215*d* and 216*d* which serve as walls for rear end channel 206. End portions 215*d* and 216*d* are perpendicular to back plate 210. The directions of walls 206*a* and 206*b* as defined from each of their respective proximal ends 206*a*′ and 206*b*′ to their respective distal ends 206*a*″ and 206*b*″ are slightly non-parallel to and slant inwardly toward end portions 215*d* and 216*d*, respectively. The width of the rear end channel 206 therefore varies from a width $w_3$ near its base to a width $w_4$ near the distal ends 206*a*″ and 206*b*″ wherein width $w_3$ is slightly greater than and width $w_4$ is slightly less than the width $w_5$ of panel member 70, as shown in FIG. 3B, for reasons to be discussed below. The length $l_4$ which represents the distance from the base of rear end channel 206, that is, from back plate 210 to base 205*c* of front end channel 205 is at least slightly greater than the length $l_1$ shown in FIG. 3B. Length $l_1$ represents the total distance from the distal end 70*a* of panel member 70 to and including leg 43*a*.

As shown in FIG. 7, which illustrates the fragmented area of assembly 20 about its right corner where sections 22 and 23 meet, corner bracket 200 is assembled as follows: Wall 205*a*, base 205*c* and end portion 215*c* of front end channel 205 are slid over L-shaped cross section 43 of strip receiving member 40 of section 22 and wall 206*a*, that portion of back plate 210 and end portion 215*d* of rear end channel 206 slidably receive panel member 70 of section 22 until panel member 70 is in contact with planar surface 216*a* of side member 216.

Since width $w_2$ of front end channel 205 is greater than length $l_2$ of leg 43*a*, front end channel 205 completely overlaps and encompasses leg 43*a* of L-shaped cross sectional portion 43. Wall 205*a* is also dimensioned to extend toward planar front side 45*b* of strip receiving member 40 but does not come in contact with the strip 30 seated within channels 46–47. As previously noted, simultaneous with the insertion of L-shaped cross section 43 of section 22 in front end channel 205, panel member 70 of section 22 is slidably received by rear end channel 206 so as to engage and secure panel member 70 within rear end channel 206. Wall 206*a* is sufficiently resilient so that as panel member 70 is slidably received by rear end channel 206, the distal end of wall 206*a* bends away from end portion 215*d* but remains in contact with panel member 70 so as to accommodate the wider width $w_5$ of panel member 70 compared to the smaller width $w_4$ of rear end channel 206 at the distal end of wall 205*a*. Consequently, wall 206*a* presses against panel member 70 to ensure that the latter is secured within rear end channel 206. Section 23 is connected to corner bracket 200 using wall 205*b*, base 205*c* and end portion 216*c* of front end channel 205 and using wall 206*b*, that portion of back plate 210 and end portion 216*d* of rear end channel 206 in a similar fashion to that disclosed above for section 22. Similarly, the left corner bracket, which is identical to the right corner bracket, is attached to sections 21 and 22. In one preferred embodiment of the present invention for each of the two corner brackets, a screw is screwed into frame 24 with a portion of the stem and the head of the screw protruding above the surface of frame 24 approximately one eighth ($\frac{1}{8}$) of an inch so that keyhole 210*a* can be slipped onto the stem off the screw. Consequently, each corner bracket 200 and therefore the entire assembly 20 is secured to frame 24. The order in which the right corner bracket 200 is connected to sections 22 and 23, of course, may be switched such that section 23 is first connected to right corner bracket 200 followed by connection of section 22 to right corner bracket 200. The left and right corner brackets 200, therefore, provide not only a further decorative finish to the corners of assembly 20 so as to cover any unsightly junctions formed between panel members 70 of adjoining sections of the assembly but also provide additional means for holding adjoining sections together. Each corner bracket 200 also is easily connected to each of the two adjoining sections so as to provide a simple and quick means for connecting the assembly to frame 24. Furthermore, potential warpage between panel members 70 of adjoining sections which can form a gap therebetween is substantially avoided due to corner brackets 200.

Referring now to FIGS. 8A and 8B, right bottom bracket 300 comprises a first trench member 310, a second trench member 320, a back plate 330, a first member 340 and a second ledge member 350. First trench member 310 comprises walls 301, 302, 303 and a base 304. Wall 303, which is perpendicular to walls 301 and 302, is integrally connected at its first end to one end of wall 301 and at its second end to one end of wall 302. The length of wall 303, that, is, the width of first trench member 310 is equal to a distance of $w_6$. Walls 301, 302 and 303 are perpendicular to the base 304. First trench member 310 further comprises a protrusion 305 connected to wall 302 which has the shape of a substantially rectangular block shape and which protrudes away from wall 302 as discussed in greater detail below. Walls 301, 302 and 303 rise from base 304 to a top surface 310*a* of first trench member 310. Top surface 310*a* is substantially planar in shape, parallel to base 304 and perpendicular to walls 301, 302 and 303. Second trench member 320 comprises walls 321, 322 and 323 and a base 324. Wall 323, which is perpendicular to walls 321 and 322, is integrally connected at its first end to one end of wall 321 and at its second end to one end of wall 322. The length of wall 323, that is, the width of second trench member 320 is equal to a distance $w_7$. Walls 321, 322 and 323 are perpendicular to and rise from base 324. Bases 304 and 324 are of the same thickness and integrally connected together to form a planar surface. Wall 321 of second trench member 320 is integrally connected and perpendicular to wall 301 of first trench member 310. Wall 322 of second trench member 320 is integrally connected and perpendicular to wall 302 of first trench member 310. The length of wall 321 is slightly longer than the length of wall 322 by an extra distance equal to the width $w_6$ of first trench member 310. The length of wall 301 is slightly longer than the length of wall 302 by an extra distance equal to the width $w_7$ of second trench member 320. Based on the foregoing construction, first trench member 310 and second trench member 320 can be viewed as forming a single trench which follows a 90 degree path.

Protrusion 305, which has two side surfaces 305*a* and 305*b* and a front surface 305*c*, is centered within the middle of first trench member 310 such that the perpendicular distances from side surface 305*a* to wall 303 and from side surface 305*b* to wall 321 are equal to a length $g_2$. Similar to walls 301, 302 and 303, surfaces 305*a*, 305*b* and 305*c* rise from base 304 to top surface 310*a*. Side surfaces 305*a* and 305*b* are perpendicular to front surface 305*c*. First trench member 310 has a somewhat hour glass shape with wider portions at either end and a narrower, that is, tapered middle portion. More specifically, at either end of first trench member 310 a width $w_6$ separates wall 301 from wall 302 whereas near and at the middle of first trench member 310 a narrower width $w_8$ separates wall 301 from front surface 305*c* of protrusion 305. The length $l_5$ of first trench member 310, that is, the perpendicular distance between walls 303 and 321 is slightly larger than length $l_3$ which, as shown in FIG. 3B, represents the distance between exterior side 225 of panel member 70 and side 100 of stem 44*b*. Additionally, the length $l_6$ of second trench member 320, that is, the perpendicular distance between walls 301 and 323 is slightly larger than length $l_1$, which as shown in FIG. 3B, represents the perpendicular distance between distal end 70*a* of panel member 70 and side 101 of leg 43*a*. Walls 301, 302 and 303 of first trench member 310 are of the same height as wals 321 and 323 of second trench member 320. Wall 322 of second trench member 320, however, rises from a height equal to the height of wall 302 to a height equal to the height of back plate 330 as seen in FIG. 8A.

Back plate 330, which has a thickness $t_3$, includes a keyhole 330*a* having a top 330*b*. Back plate 330, which is integrally connected and perpendicular to wall 322, is similar in construction to back plate 210 of corner bracket 200 and therefore need not be further described herein. First ledge member 340 and second ledge member 350 have substantially flat top, side and bottom surfaces and lie in a common plane. First ledge member 340 is conneced to base 304 of first trench member 310. Second ledge member 350 is connected to both bases 304 and 324. First ledge member 340 has a width $w_9$ and second ledge member 350 has a width $w_{10}$. The width of the second ledge member 350 may be expanded to contact first ledge member 340 so as to form one integral ledge. The length $l_7$ of second ledge member 350 is less than the length $l_8$ of first ledge member 340 so as to accommodate the insertion of a screw, nail or other attaching element into keyhole 330*a* of back plate 330. A side 341 of first ledge member 340 lies in the same plane as a side 331 of back plate 330. Accordingly, when back plate 330 is connected to frame 24, first ledge member 340 will be in contact with frame 24 as shown in FIG. 9B.

Referring now to FIG. 9A, which shows a rear perspective view of the bottom of section 23, right bottom bracket 300 is attached to the bottom section 23 as follows: Ends of strip receiving member 40 and of panel member 70 of sections 23 are inserted into and slidably received by first trench member 310 and second trench member 320, respectively. More particularly, the two sides of strip receiving member 40 defined as the areas encompassing cross sectional portion 43 and groove shaped member 53 and the areas encompassing cross sectional portion 44 and groove shaped member 54 are slid into and seated within the two areas of first trench member 310 defined by widths $w_6$ and lengths $g_2$. The rest of strip receiving member 40 is snugly seated between these two defined areas. In this regard, as strip receiving member 40 of section 23 is slid into first trench member 310, protrusion 305 of first trench member 310 comes into contact with planar rear side 45*a* of planar body 45 and thereby secures and engages the seated portion of strip receiving member 40 within first trench member 310. The width $w_7$ of second trench member 320 is dimensioned so that the walls 321 and 322 come into contact with the exterior side 225 and interior side 220 of panel member 70 as the latter is seated within second trench member 320, respectively. Thus, the seated portion of panel member 70 is engaged within second trench member 320.

As shown in FIG. 9B, for securing lambrequin assembly 20 to the window frame 24 an attaching element such as, but not limited to, a screw 24*a* is partially screwed into frame 24 with a portion of the stem and head of screw 24*a* protruding above the surface of frame 24 such that the protruding portion of screw 24*a* is at least equal to the thickness $t_3$ of back plate 300 (that is, approximately one eighth ($\frac{1}{8}$) of an inch). Consequently, by slipping that portion of screw 24*a* protruding above frame 24 through and into keyhole 330*a* until the stem comes into contact with the top 330*b* of keyhole 330*a*, the right bottom bracket and thereby section 23 of lambrequin assembly 20, which is seated within trench members 310 and 320 of the right bottom bracket, is attached to frame 24.

As discussed above, FIGS. 8A, 8B, 9A and 9B illustrate the right bottom corner of assembly 20 and its use with the bottom section 23. A bracket 300 for use with the left bottom corner of assembly 20, that is, with the bottom of section 21 is shown in FIG. 1 and is similar to that shown in FIGS. 8A, 8B, 9A and 9B.

Furthermore, once bottom brackets 300 are secured to frame 24 as described above, first ledge member 340 of each bottom bracket 300 will be in contact with frame 24. Consequently, first ledge member 24 of each bottom bracket provides a countervailing and stabilizing force against any rotational movement or torque of sections 21 and 23 toward and into frame 24 and window 25. Additionally, second trench member 350 of each bottom bracket by extending along and connected to bases 304 and 342 of first trench member 310 and second trench member 320, respectively, provides a countervailing force against any warpage of first trench member 310 relative to second trench member 320.

Quite often, a vertically collapsible window covering such as blind or shade 27 may have a vertical length which when fully extended is greater than the vertical length of window 25. In order to prevent such blind or shade 27 from extending beneath bottom brackets 300, first ledge member 340 and second ledge member 350 of each bottom bracket 300 also serve to catch and support blind or shade 27 if the latter comes into contact with the former.

Figure 10A:
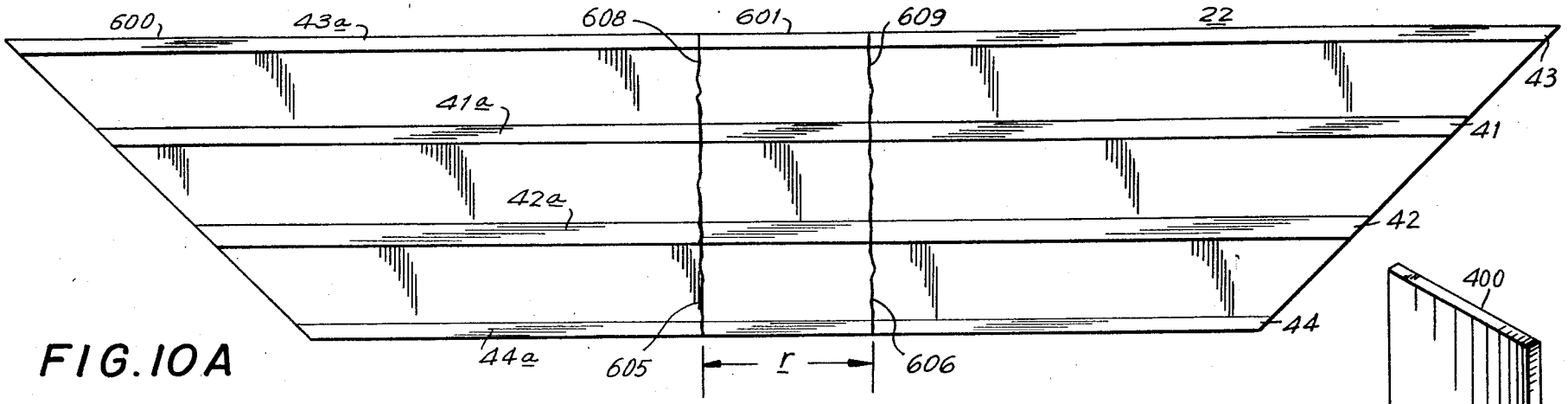
FIGS. 10A and 10B are front elevational views of a section of a lambrequin assembly cut into three pieces and after rejoining two of the three pieces, respectively.
Figure 11:
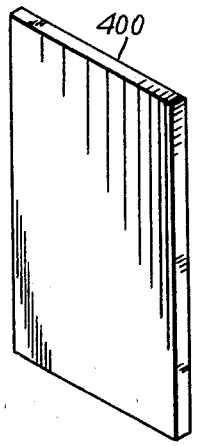
FIG. 11 is a front perspective view of a connector for joining together the two pieces of FIG. 10B.
Figure 10B:
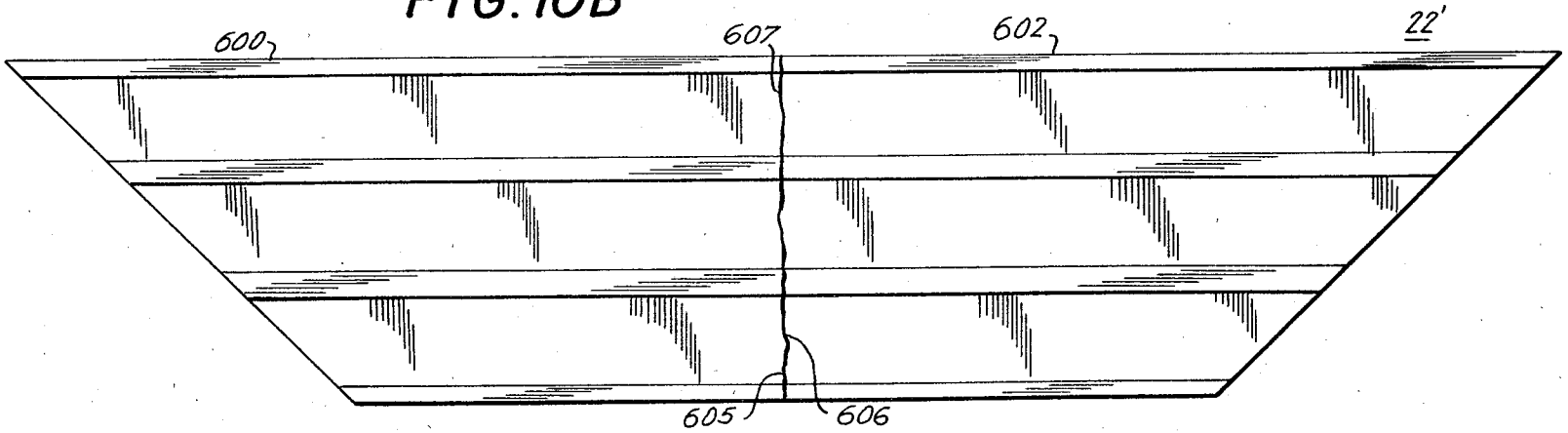

In the event that frame 24 is not of a standard size, each of the sections of lambrequin assembly 20 can be increased or reduced in length. For example, in order to reduce the length of one or more sections of assembly 20 so as to cover an unusually small frame, any one of the sections such as section 22, is first cut into three pieces 600, 601 and 602, as shown in FIG. 10A. Sections 601 and 602 are then rejoined (as described above) so as to form a section 22' of reduced length as shown in FIG. 10B. The length of piece 601 is equal to the desired reduction in length r of section 22. Ends 605 and 606 of pieces 600 and 602, respectively, are cut at right angles relative to the direction in which the groove shaped members 53 and 54 extend. For joining pieces 600 and 602 together and as shown in FIG. 11, a connector 400 comprises front, rear and side planar surfaces in the shape of a rectangular block. Connector 400 is dimensioned to be slidably insertable and frictionally held in place by groove shaped members 53 and 54 of pieces 600 and 602. Thus, by sliding connector 400 first into groove shaped members 53 and 54 of either piece 600 or 602 and then into groove shaped members 53 and 54 of the other piece (600 or 602) and then pushing pieces 600 and 602 towards each other so that ends 605 and 606 will abut each other, a shortened section 22' is formed.

Conversely, if a section needs to be expanded in order to conform to the perimeter of the passageway, one can view the length of the original section as section 22' of FIG. 10B. In this instance, it may be desired to increase the length of section 22' by a length r. Section 22' would then be cut into pieces 600 and 602 having ends 605 and 606 which are at right angles relative to the direction in which grooved shaped members 53 and 54 extend. An additional section 601 having a length r would be added between pieces 600 and 602 as shown in FIG. 10A wherein either one or two connectors 400 would be used to join additional section 60 to pieces 600 and 602 depending on the length r of additional section 601 relative to the length of connector 400.

Figure 12:
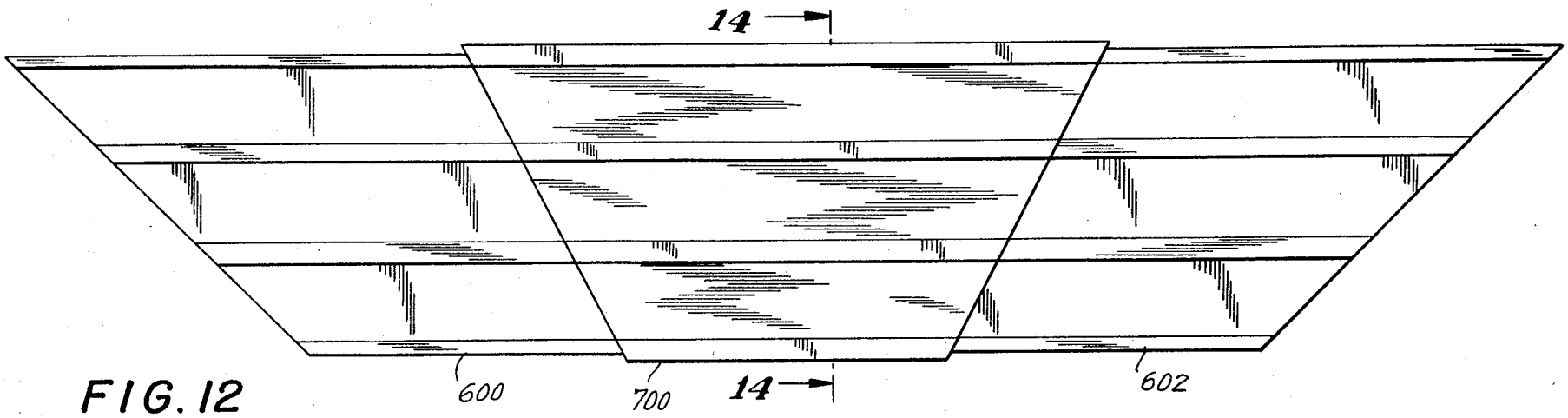
FIG. 12 is the front elevational view of FIG. 10B with a mask member covering the junction between the two rejoined pieces.

In the event that a section of the assembly 20 has been cut into pieces so as to increase or reduce its length, the junction 607 formed between ends 605 and 606 or the junctions 608 and 609 formed between pieces 600, 601 and 602, respectively, and especially the tops 41*a* and 42*a* and legs 43*a* and 44*a* which provide the rib-like effect previously described, may appear somewhat ragged and therefore unfinished due to the property characteristics of the materials used to make assembly 20 when cut and/or the cutting implement used to cut the section. The types of materials used to make the assembly are discussed below. In order to cover these junctions so as to provide a finished and attractive appearance to assembly 20, a mask member 700, illustrated in FIG. 12, is used.

Figure 13:
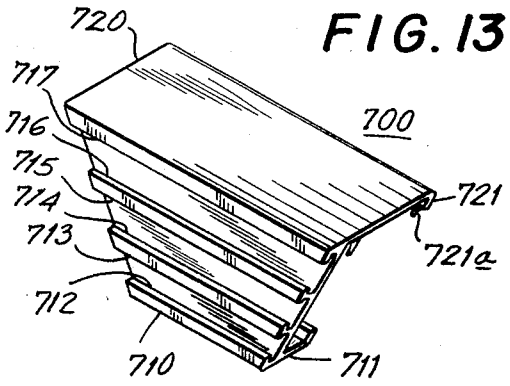
FIG. 13 is a front perspective view of the mask member.

Referring now to FIG. 13, mask member 700 comprises an outer strip receiving member 710 and outer panel member 720. Outer strip receiving member 710 is similar to strip receiving member 40 comprising channels 712–717 for receiving the strips of material 30 similar to channels 46–51, respectively. Strip receiving member 710, however, does not have the grooved shaped members 53 and 54 but instead has an overlapping channel 711 which is shaped similar to but larger than groove shaped member 54. Overlapping channel 711 is located on the inner side of outer strip receiving member 710 and is hidden from view when positioned on lambrequin assembly 20 as shown in FIG. 12. Overlapping channel 711 is also disposed opposite channel 712. Outer panel 720 is shaped similar to panel member 70 but for an overlapping channel 721 which has an arcuate cross sectional shaped leg 721*a* and which extends across the entire length of outer panel 720 and is located at the distal end of outer panel member 720. Overlapping channel 721 is also hidden from view when positioned on lambrequin assembly 20.

Figure 14:
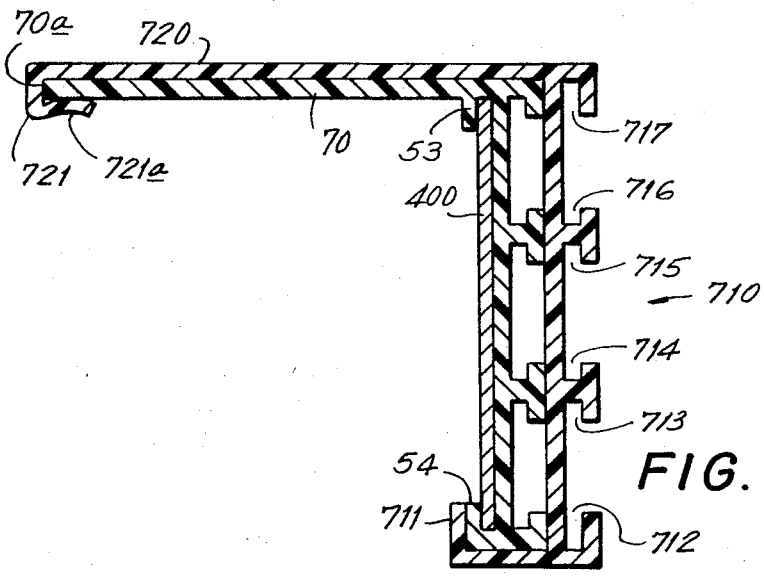
FIG. 14 is a sectioned view taken along the lines 14—14 of FIG. 12.

As shown in FIG. 14, mask member 700 is connected to any one of the modified sections near and at the junction(s) as follows: For illustrative purposes only, lambrequin assembly 20 will be assumed to have been reduced in length so that there are only pieces 600 and 602 having a junction 607 which is to be covered by mask member 700. Prior to joining pieces 600 and 602 together, connector 400 is inserted within grooved shaped membes 53 and 54 of section 602 and mask member 700 is slid over section 602 such that a portion of panel member 70 including distal end 70*a* is slidably received, overlapped and engaged by overlapping channel 721 and such that L-shaped cross sectional portion 54 is slidably received, overlapped and engaged by overlapping channel 711. In particular, leg 721*a* due to its resiliency and arcuate cross sectional shape presses against that portion of panel member 70 slidably received by overlapping channel 721 so as to press against and thereby secure the received portion of panel member 70 within overlapping channel 721. Panel member 70 and L-shaped cross sectional portion 54 are slid approximately halfway across mask member 700. Piece 600 is then slidably received and engaged by overlapping channel 721 and overlapping channel 711 as described above for piece 602. At the same time, connector 400 is slidably received and engaged by the L-shaped cross sectional portions 53 and 54 of piece 600. Consequently, pieces 600 and 602 are securely joined together by connector 400 while mask member 700 downwardly covers junction 607 and also provides additional strength for holding pieces 600 and 602 together.

Preferably, the entire lambrequin assembly is made from extrudable materials such as, but not limited to, acrylic, polyvinylchloride and/or polystyrene using standard extrusion techniques of manufacture. The surfaces of the lambrequin assembly can be treated to give a simulated wood grain finish or other decorative effect.

The lambrequin assembly can be further modified so that strip receiving member 40 on one or more of the sections has a smooth finish which is unable to receive strips 30. For example, it may be desired that strips 30 be displayed on section 22 only. Accordingly, strip receiving members of sections 21 and 23 would be manufactured without inverted L-shaped cross sectional portions 43 and 44 and T-shaped cross sectional portions 41 and 42. Thus, rather than projecting a rib-like appearance against a background of decorative material, strip receiving members 40 of sections 21 and 23 would protect the smooth, planar, attractive surface of front side 45*b* for viewing.

It will now be appreciated from the foregoing that the present invention provides a new and improved lambrequin assembly which significantly reduces the number of parts required for and cost of manufacturing the assembly and is simple to assemble. Lambrequin assembly 20 also provides a number of important benefits including the ability to absorb disturbing and unwanted noises sufficiently filtered by translucent body 25 and to control the amount of light and thermal energy entering or escaping through translucent body 25. Thus, for example, a house having window frames covered by lambrequin assemblies 20, will be cooler in the summer and warmer in the winter. Furthermore, the unsightly top of a shade/blind 27 will be hidden from view by assembly 20. Still further, by using the corner brackets 200 and bottom brackets 300, a simple, quick and clean means for attaching the assembly to the frame is provided. Of course, if desired the assembly can be attached to the wall 26 adjacent frame 24 rather than to frame 24 as described heretofore. Additionally, any unfinished edges at the ends of or junctions between the sections are eliminated by these brackets. The bottom brackets advantageously substantially prevent any rotational movement of the assembly toward the window whereas the corner brackets advantageously substantially prevent any potential warpage between panel members 70 of adjoining sections. It is also to be appreciated that the cooperation of corner brackets 200 with bottom brackets 300 ensures that lambrequin assembly 20 is firmly secured to frame 24 without requiring the aid of any additional brackets.

Having specifically described illustrative embodiments of the invention with reference to the accompanying drawings, it is to be understood that the invention is not limited to those precise embodiments and that various changes and modifications may be effected therein by one skilled in the art without departing from the scope and spirit of the invention as defined in the appended claims.

We claim:

1. In a lambrequin assembly having a plurality of sections in which one side of each section includes a strip receiving member for partially concealing the perimeter of a passageway to which the assembly is attached, said strip receiving member having at least inner channel means and outerchannel means for receiving and displaying at least one strip of decorative material, and in which each section further includes panel means for partially concealing the perimeter of the passageway to which the assembly is attached, bracket means for joining two of said plurality of sections together and having front and rear ends comprise:

front end channel means located at the front end of the bracket means and operable for overlapping and slidably receiving each of the outer channel means of the two adjoining sections so as to secure the front end of the bracket means to the two adjoining sections at and near the junction formed by the two sections; and rear end channel means located at the rear end of the bracket means and operable for slidably receiving and engaging each of the panel means of the two adjoining sections so as to secure the rear end of the bracket means to the two adjoining sections at and near the junction formed by the two sections.

2. A bracket means as in claim 1; wherein the bracket means further comprise back plate means having aperture means operable for permitting an attaching element to pass therethrough and into the perimeter of the passageway so as to secure the bracket means and thereby the two adjoining sections of the lambrequin assembly to the perimeter of the passageway.

3. A bracket means as in claim 2; wherein the front end channel means and rear end channel means each form a path of 90 degrees.

4. A bracket means as in claim 3; wherein the rear end channel means comprise two pairs of walls one pair of which are resilient and extend toward the other pair of walls such that said one pair of walls comes into contact with and presses against the slidably received panel means.

5. For securing a sectionalized lambrequin assembly by bracket means to the perimeter of a passageway in which each section includes a strip receiving member for partially concealing the perimeter of the passageway, said strip receiving member having inner and outer channel means for receiving and displaying at least one strip of decorative material and in which each section includes panel means also for partially concealing the perimeter of the passageway, bracket means comprise:

first trench means operable for seating and supporting the strip receiving member of one of said plurality of sections therein; and second treach means operable for seating and supporting the panel means of said one of said plurality of sections therein.

6. A bracket means as in claim 5; wherein the width of the first trench means tapers about its center so as to engage and secure the seated one of said plurality of sections within the first trench means.

7. A bracket means as in claim 6; wherein said assembly further comprises first ledge means connected to the first trench means and operable for stabilizing and thereby preventing rotational movement of said one of said plurality of sections relative to the perimeter of the passageway.

8. A bracket means as in claim 7; wherein said first ledge means is in contact with the perimeter of the passageway.

9. A bracket means as in claim 8; wherein said first ledge means extends in a perpendicular direction relative to the direction in which said first trench means extends.

10. A bracket means as in claim 9; wherein the bracket means further comprises back plate means having aperture means operable for permitting an attaching element to pass therethrough and into the perimeter of the passageway so as to secure the bracket means and thereby said one of said plurality of sections to the perimeter of the passageway.

11. A bracket means as in claim 10; wherein the second trench means is connected to the first trench means and extends in a perpendicular direction relative to the direction in which the first trench means extends.

12. A bracket means as in claim 11; wherein the bracket means further comprise second ledge means connected to both the first trench means and second trench means to prevent warping of the first trench means relative to the second trench means.

13. A bracket means as in claim 12; wherein the passageway is covered by a vertically collapsible covering and wherein the bracket means further comprises catch means for catching and thereby preventing the bottom of the covering from extending beneath the bracket means.

14. A bracket means as in claim 13; wherein the first ledge means and second ledge means serve as the catch means.

15. In a lambrequin assembly having a plurality of sections in which each section has panel means for partially covering the perimeter of a passageway to which the assembly is attached, said panel means having a proximal edge and distal edge, and in which each section has a strip receiving member which includes on one side thereof at least inner and outer channel means for receiving and displaying at least one strip of decorative material and has on the other side thereof a pair of groove shaped members disposed opposite to the inner and outer channel means wherein in each section the strip receiving member is connected to the proximal edge of the panel means; mask means for covering a junction between two of the sections next adjacent each other comprise:

outer panel means for overlapping the panel means of said two sections, said outer panel means including first overlapping channel means for overlapping and slidably receiving at least the distal edges of the panel means of said two sections; and an outer strip receiving member for overlapping the strip receiving members of said two sections, said outer strip receiving member including second overlapping channel means for slidably receiving and engaging one of said pair of groove shaped members of each of said two sections.

16. A mask means as in claim 15; wherein the outer strip receiving member has on one side thereof at least two channel means for receiving and displaying at least one strip of decorative material and has on the other side thereof the second overlapping channel means disposed opposite to one of the at least two channel means.

17. A mask means as in claim 16; wherein the first overlapping channel means has an arcuate cross sectional shaped leg of resilient material which presses against the slidably received panel means.

18. A mask means as in claim 17; wherein the inner and outer channel means of said two sections extend in the same direction.

19. A lambrequin assembly attached to the perimeter of a passageway and having a plurality of sections for displaying at least one strip of decorative material in each of the sections comprising:

a strip receiving member which includes on one side thereof inner channel means and outer channel means for receiving and displaying said at least one strip of decorative material and which includes on the other side thereof groove shaped members disposed opposite to the inner and outer channel means;

interlocking means for engagement with the grooved shaped members;

panel means for partially covering the perimeter of the passageway and which has a proximal edge connected to the strip receiving member and a distal edge;

corner bracket means for joining adjacent sections of the assembly together wherein each corner bracket means includes front and rear ends, front end channel means located at the front end of the corner bracket means and operable for overlapping and slidably receiving each of the outer channel means of the two adjoining sections so as to secure the front end of the corner bracket means to the two adjoining sections at and near the junction formed by the two sections, and rear end channel means located at the rear end of the corner bracket means and operable for slidably receiving and engaging each of the panel means of the two adjoining sections so as to secure the rear end of the corner bracket means to the two adjoining sections at and near the junction formed by the two sections;

bottom bracket means which include first trench means being tapered about its center and operable for engagingly seating and supporting the strip receiving member of one of said plurality of sections therein, second trench means also operable for seating and supporting therein the panel means of one of said plurality of sections which is seated in and supported by the first trench means, first ledge means connected to the first trench means and operable for stabilizing and thereby preventing rotational movement of the plurality of sections relative to the perimeter of the passageway, and second ledge means connected to both the first and second trench means to prevent warping of the first trench means relative to the second trench means; and mask means for covering a junction between two of the plurality of sections which are next adjacent each other and which have inner and outer channel means extending in the same direction wherein the mask means include outer panel means for overlapping the panel means of these next adjacent sections, said outer panel means including first overlapping channel means for overlapping and slidably receiving at least the distal edges of the panel means of these next adjacent sections, and an outer strip receiving member for overlapping the strip receiving members of these next adjacent sections, said outer strip receiving member including second overlapping channel means for slidably receiving and engaging one of said pair of groove shaped members of each of these next adjacent sections.

* * * * *